US006176727B1

(12) United States Patent
Liu et al.

(10) Patent No.: US 6,176,727 B1
(45) Date of Patent: Jan. 23, 2001

(54) TERMINATOR BOARD HOLDER

(75) Inventors: Ke-Cheng Liu; Chu-Mei Chen, both of Taipei; Yi-Sung Lin, Hsin-Chung, all of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/354,174

(22) Filed: Jul. 15, 1999

(30) Foreign Application Priority Data

Dec. 31, 1998 (TW) ..... 87222082

(51) Int. Cl.[7] ..... H01R 13/627
(52) U.S. Cl. ..... 439/358; 439/327
(58) Field of Search ..... 439/327, 326, 439/358, 328, 483, 484; 361/683, 684, 741, 802

(56) References Cited

U.S. PATENT DOCUMENTS 5,943,218 * 8/1999 Liu ..... 361/801
6,045,385 * 4/2000 Kane ..... 439/327
6,056,579 * 5/2000 Richards, III et al. ..... 439/358

* cited by examiner

*Primary Examiner*—Brian Sircus
*Assistant Examiner*—Son V. Nguyen
(74) *Attorney, Agent, or Firm*—Wei Te Chung

(57) ABSTRACT

A terminator board holder includes a beam and two support arms extending from opposite ends of the beam to form a U-shaped configuration defining an interior space for receiving a circuit board therein. Retaining members are formed on the beam and support arms in the interior space for retaining the circuit board. Each support arm has a reduced thickness for enhancing the resiliency thereof. A manipulating arm extends from each support arm, and is substantially parallel thereto and spaced therefrom. A barb is formed on each manipulating arm for engaging with an opening defined in a card edge connector thereby securing the terminator board holder in the connector. The barb has an arcuate engaging surface for accommodating a gap defined between the barb and the opening resulting from manufacturing tolerances. The manipulating arms have free ends extending beyond the beam and being connected by a flexible connection member whereby deflecting the flexible connection member causes the manipulating arms to deflect simultaneously to release the barbs from the openings of the connector.

1 Claim, 4 Drawing Sheets

TERMINATOR BOARD HOLDER

BACKGROUND OF THE INVENTION

1. Field of the Invention

The present invention generally relates to a terminator board holder for mounting a terminator board to a card edge connector, and in particular to a low profile terminator board holder for facilitating connection of a terminator board with a card edge connector.

2. The Prior Art

A terminator board holder mounts a terminator board or a memory module to a card edge connector. An example of a terminator board holder is disclosed in U.S. Pat. No. 5,419,712 that teaches a holder structure as shown in FIG. 1 of the attached drawings. The conventional holder structure comprises a rigid beam 94 to which a circuit board 36 is mounted. The rigid beam 94 has a pair of latching arms 92 extending from a bottom face thereof and a pair of arcuate projections 96 formed on a top face thereof corresponding to the latching arms 92. Each latching arm 92 has a barbed end 98 for engaging with a corresponding opening defined in a card edge connector (not shown) thereby securing the circuit board 36 to the card edge connector. To remove the circuit board 36 from the card edge connector, the projections 96 are depressed to drive the barbed ends 98 outward thereby releasing the barbed ends 98 from the card edge connector.

The latching arms 92 of the conventional terminator board holder are elongate whereby the terminator board holder occupies a significant amount of space. However, shortening the latching arms 92 to reduce the size of the terminator board holder would require a large force to release the terminator board holder from the card edge connector. Furthermore, due to manufacturing tolerances, a gap exists between the barb 98 and the corresponding opening of the card edge connector which may result in relative movement of the terminator board mounted therein with respect to the card edge connector.

It is thus desired to have a low profile terminator holder that overcomes the above-discussed problems.

SUMMARY OF THE INVENTION

Accordingly, an object of the present invention is to provide a low profile terminator board holder.

Another object of the present invention is to provide a terminator board holder that facilitates mounting/dismounting of the terminator board to/from a card edge connector.

A further object of the present invention is to provide a terminator board holder that effectively reduces potential relative movement of a terminator board mounted therein with respect to a card edge connector.

To achieve the above objects, a terminator board holder in accordance with the present invention comprises a beam and two support arms extending from opposite ends of the beam to form a U-shaped configuration defining an interior space for receiving a circuit board therein. Retaining members are formed on the beam and support arms in the interior space for retaining the circuit board. Each support arm has a reduced thickness for enhancing the resiliency thereof. A manipulating arm extends from each support arm, and is substantially parallel thereto and spaced therefrom. A barb is formed on each manipulating arm for engaging with an opening defined in a card edge connector thereby securing the terminator board holder in the connector. The barb has an arcuate engaging surface for accommodating a gap defined between the barb and the opening resulting from manufacturing tolerances. The manipulating arms have free ends extending beyond the beam and being connected by a flexible connection member whereby deflecting the flexible connection member causes the manipulating arms to deflect simultaneously to release the barbs from the openings of the connector.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 2:
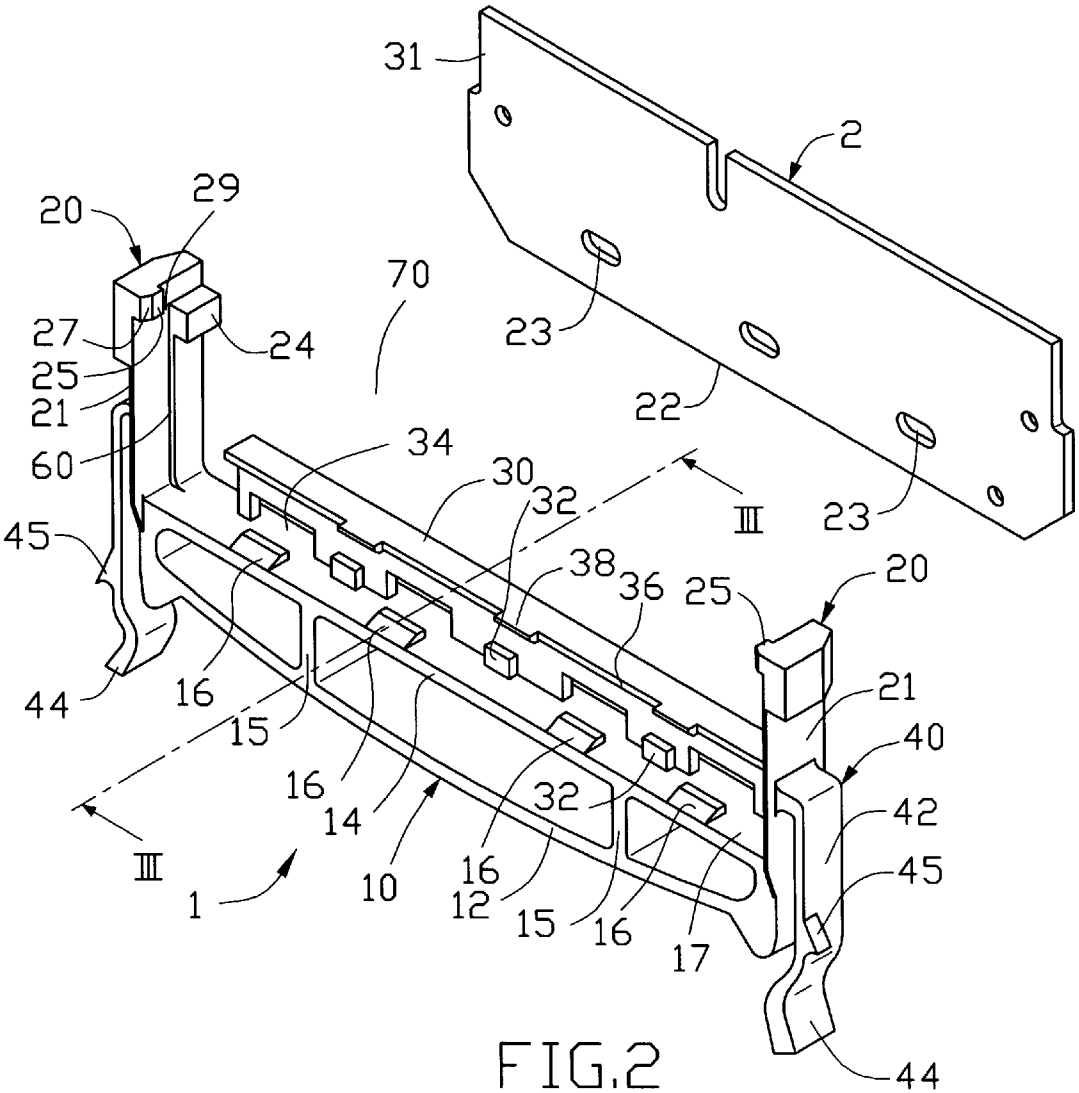
FIG. 2 is a perspective view of a terminator board holder constructed in accordance with a first embodiment of the present invention and a terminator board to be mounted thereto.
Figure 3:
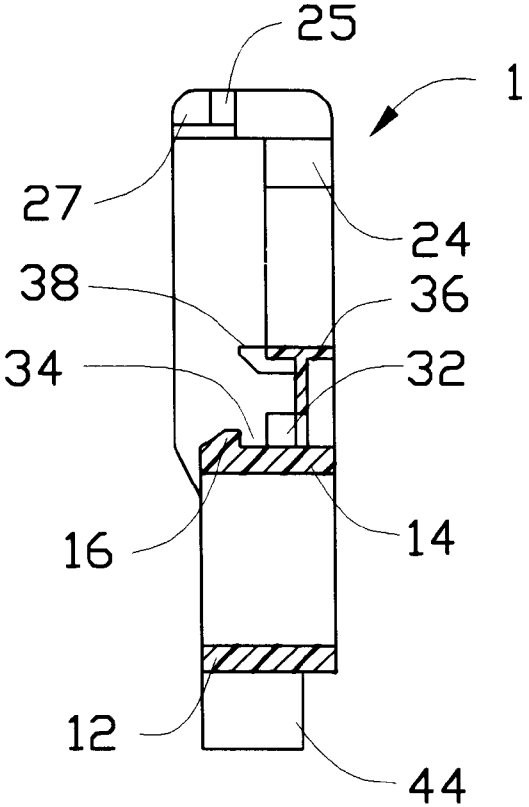
FIG. 3 is a cross-sectional view of the terminator board holder of the present invention.

Referring to the drawings and in particular to FIGS. 2 and 3, a terminator board holder 1 constructed in accordance with the present invention comprises a substantially rigid beam 10 and two support arms 20 each having a resilient, elongate body 21 extending from opposite ends of the beam 10 thereby forming a U-shaped configuration defining an interior space 70 therebetween for receiving a terminator board 2. The beam 10 comprises a straight bar 14 and an arcuate bar 12 connected together by webs 15 and defining spaces (not labeled) therebetween for facilitating manual operation.

A board support plate 30 is formed on an outside face 17 of the straight bar 14 in the interior space 70 and substantially co-extensive therewith for supporting the terminator board 2. The board support plate 30 forms a number of barbs 38 on an edge 36 thereof. The barbs 38 correspond in size and number to slots 23 defined in the terminator board 2 and engage therewith for retaining the terminator board 2 in the terminator board holder 1.

Two rows of first and second blocks 32, 16 are formed on the outside face 17 of the straight bar 14. The row of first blocks 32 forms a first surface and the row of second blocks 16 forms a second surface spaced from the first surface to define a receiving channel 34 therebetween for receiving a first edge 22 of the terminator board 2. Preferably, the first and second blocks 32, 16 are alternately arranged.

Each support arm 20 has a third block 24 and a fourth block 25 formed on an inside face thereof. The third and fourth blocks 24, 25 are spaced from each other and define a receiving channel 29 therebetween for receiving a lateral edge 31 of the terminator board 2.

Figure 1:
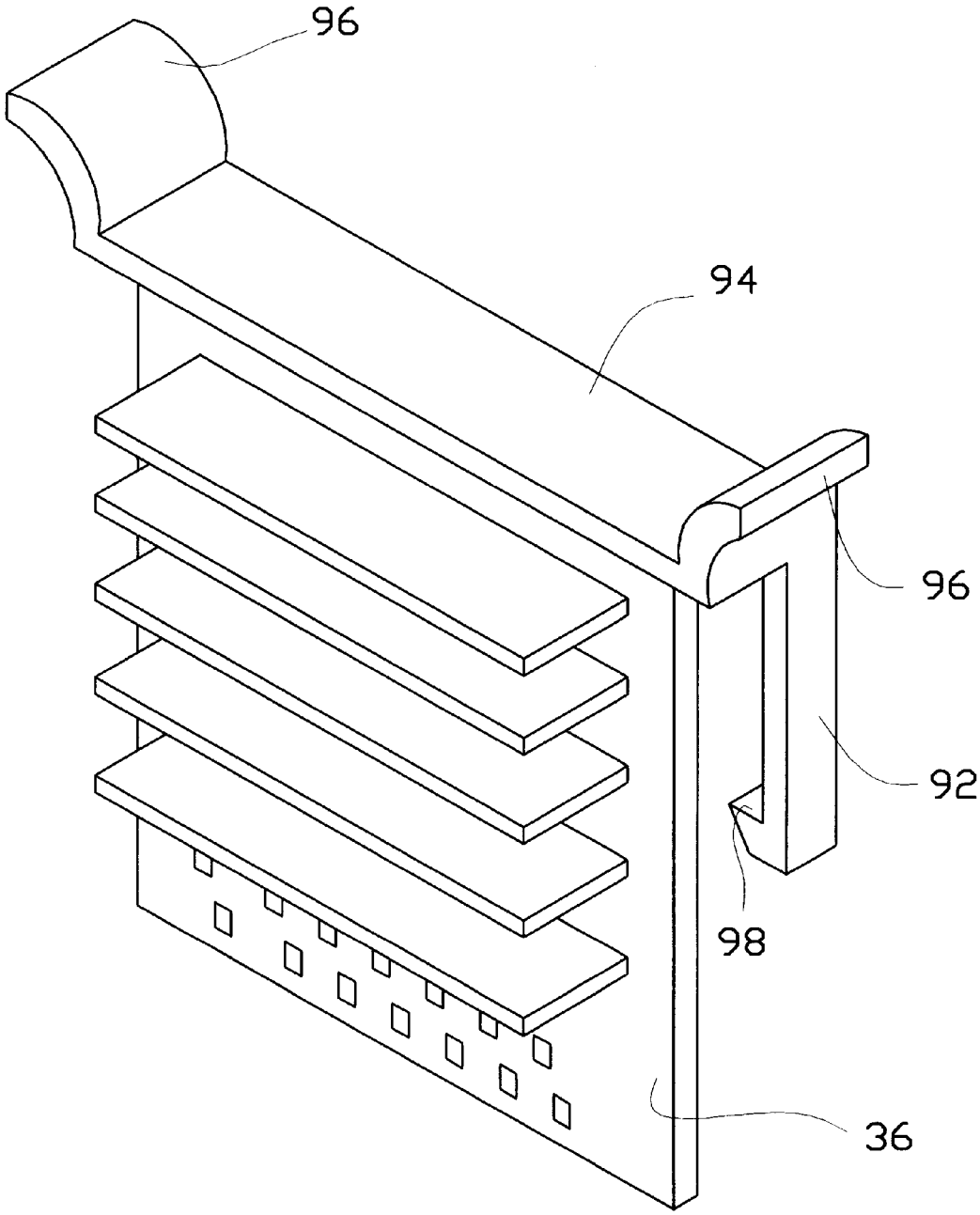
FIG.1 PRIOR ART
FIG. 1 is a perspective view of a conventional terminator board holder.

Preferably, a step 60 is formed on the inside face of each support arm 20 for supporting the lateral edge 31 of the terminator board 2. The formation of the step 60 reduces the thickness of at least a portion of the support arm 20 which enhances the resiliency thereof whereby the support arm 20 is readily deflectable even though the support arm 20 is shortened compared to the conventional design shown in FIG. 1. The step 60 is not required to support the lateral edge 31 if a further reduction of the thickness of a greater portion of the support arm 20 is desired since the third block 24 can sufficiently support the lateral edge 31 of the terminator board 2.

Figure 4:
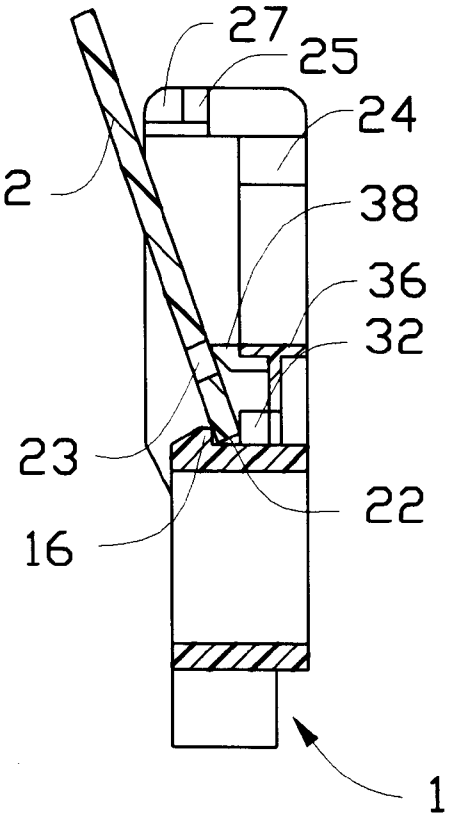
FIG. 4 is cross-sectional view of the terminator board holder of the present invention showing a terminator board mounted therein.

The fourth block 25 has an inclined face 27 for facilitating insertion of the lateral edge 31 of the terminator board 2 into the receiving channel 29. As shown in FIG. 4, the first edge 22 of the terminator board 2 is positioned at an incline in the receiving channel 34 on the outside face 17 of the straight bar 14. The terminator board 2 is pushed toward the fourth blocks 25 of the support arms 20 and due to the provision of the inclined faces 27, the support arms 20 are expanded by the lateral edges 31 of the terminator board 2 to allow the lateral edges 31 of the terminator board 2 to move into the receiving channels 29. The barbs 38 of the board support plate 30 engage with the corresponding slots 23 of the terminator board 2 to securely retain the terminator board 2 in the holder 1.

A manipulating arm 40 comprises an elongate body 42 extending from each support arm 20 and being substantially parallel to and spaced from the elongate body 21 of the support arm 20. The mainpulating arm 40 together with the support arm 20 forms a generally h-shaped configuration (see FIG. 2). The elongate body 42 of the manipulating arm 40 has a free end 44 extending beyond the beam 10 and forming a recessed finger holding section (not labeled) for facilitating manual operation. A barb 45 is formed on each manipulating arm 40 for engaging with an opening defined in a card edge connector (not shown) which receives the terminator board holder 1 and the terminator board 2 therein for establishing electrical connection between the terminator board 2 and a circuit board on which the card edge connector is mounted.

The finger holding sections of the manipulating arms 40 allow a user to deflect the manipulating arms 40 to remove the barbs 45 from the openings of the connector thereby releasing the terminator board holder 1 from the card edge connector. The finger holding sections of the manipulating arms 40 also allow the user to outwardly expand the support arms 20 for releasing the terminator board 2 from the holder 1.

The body 42 of the manipulating arm 40 provides a long lever thereby reducing the force required to expand the support arms 20 when releasing the terminator board 2 from the holder 1. In this respect, the manipulating arms 40 have a greater bending rigidity than the support arms 20.

Figure 5:
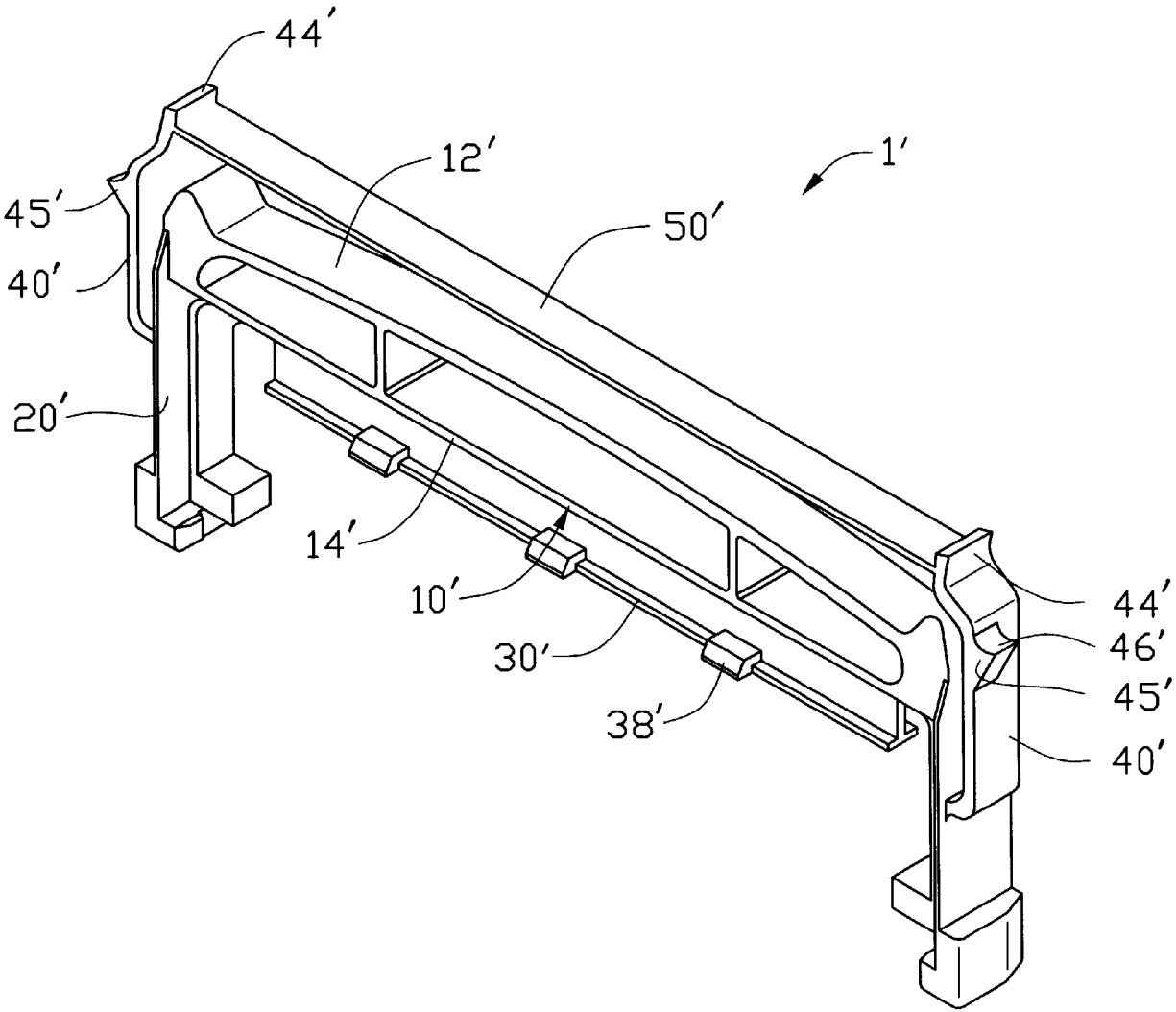
FIG. 5 is a perspective view of a terminator board holder constructed in accordance with a second embodiment of the present invention.

FIG. 5 shows a second embodiment of the present invention wherein a terminator board holder 1' substantially identical to the terminator board holder 1 of the first embodiment, comprises a rigid beam 10' including a straight bar 14' and an arcuate bar 12', and two resilient arms 20' extending from opposite ends of the rigid beam 10' thereby defining a U-shaped configuration. A board support plate 30' is mounted to the straight bar 14' for supporting a terminator board (not shown) and has barbs 38' formed thereon for engaging with slots defined in the terminator board.

Each support arm 20' has a manipulating arm 40' extending therefrom, and substantially parallel thereto and spaced therefrom. Each manipulating arm 40' has a barb 45' formed thereon for engaging with an opening defined in a card edge connector (not shown).

The manipulating arms 40' have free ends 44' extending beyond the beam 10', and a flexible connection member 50' substantially parallel to and spaced from the arcuate bar 12' is formed between the free ends 44'. A user grasps the arcuate bar 12' and the connection member 50' and applies a force to deflect the connection member 50' which drives the ends 44' of the manipulating arms 40' inward thereby releasing the barbs 45' from the card edge connector and also deflecting the support arms 20' to release the terminator board.

Preferably, each barb 45' is provided with an arcuate surface 46' for engaging with the opening defined in the card edge connector. The arcuate surface 46' accommodates manufacturing tolerance between the terminator board holder 1' and the openings of the card edge connector thereby reducing the likelihood of relative movement therebetween.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A circuit board assembly comprising a circuit board holder and a circuit board in the circuit board holder, said circuit board holder defining a beam and two support arms extending from two opposite ends of the beam, said circuit board being retainably received within an interior space defined by said beam and said two support arms, said beam including a first bar confronting the circuit board and a second bar spaced from the first bar, said two support arms having two manipulating arms respectively extending therefrom, each of said two manipulating arms forming a barb thereon for engagement with an opening defined in a connector that receives the circuit board assembly therein so as to secure the circuit board assembly in the connector, two free ends of said two manipulating arms being connected by a flexible connection member, wherein said second bar is positioned between said flexible connection member and said first bar so that by grasping both the second bar and the flexible connection member, both the flexible connection member and said two manipulating arms are deflected, thus releasing the barb of each of said manipulating arms from the opening of the connector.

* * * * *